US005127399A

United States Patent [19]

Scholley

[11] Patent Number: 5,127,399

[45] Date of Patent: * Jul. 7, 1992

[54] FLEXIBLE CONTAINER FOR COMPRESSED GASES

[76] Inventor: Frank G. Scholley, 922 E. Sparrow Rd., Virginia Beach, Va. 23464

[ * ] Notice: The portion of the term of this patent subsequent to Jun. 12, 2007 has been disclaimed.

[21] Appl. No.: 740,049

[22] Filed: Aug. 5, 1991

Related U.S. Application Data

[63] Continuation-in-part of Ser. No. 507,484, Apr. 11, 1990, Pat. No. 5,036,845, which is a continuation-in-part of Ser. No. 337,901, Apr. 14, 1989, Pat. No. 4,932,403.

[51] Int. Cl.[5] ..... A62B 7/00; A62B 9/00

[52] U.S. Cl. ..... 128/205.22; 128/204.18

[58] Field of Search ..... 128/200.24, 204.18, 128/205.22

[56] References Cited

U.S. PATENT DOCUMENTS

| | | | |
|---|---|---|---|
| 771,801 | 10/1904 | Andrew | 128/201.23 |
| 1,288,857 | 12/1918 | Farr | 128/205.22 |
| 2,120,563 | 6/1938 | Lamb | 169/91 |
| 2,380,372 | 7/1945 | Alderfer | 128/205.22 |
| 3,163,707 | 12/1964 | Darling | 128/204.18 |
| 3,338,238 | 8/1967 | Warncke | 128/205.12 |
| 3,432,060 | 3/1969 | Cowley | 128/147 |
| 3,491,752 | 1/1970 | Cowley | 128/147 |
| 4,253,454 | 3/1981 | Warncke | 128/202.26 |
| 4,300,496 | 11/1981 | Price | 128/202.13 |
| 4,932,403 | 6/1990 | Scholley | 128/205.22 |
| 5,036,845 | 8/1991 | Scholley | 128/205.22 |

FOREIGN PATENT DOCUMENTS

| | | | |
|---|---|---|---|
| 971689 | 2/1959 | Fed. Rep. of Germany | 128/205.22 |
| 1037477 | 4/1953 | France | 128/202.13 |

*Primary Examiner*—Edgar S. Burr
*Assistant Examiner*—Kimberly L. Asher
*Attorney, Agent, or Firm*—Foley & Lardner

[57] ABSTRACT

A container is formed of a liner having alternating expanded-diameter and narrow-diameter storage and connection sections, respectively. A fiber covers the liner, and a protective covering coats the fiber. The container has a valve at one end and can include a pressure valve, demand flow regulator and mouthpiece or other connection at the other end.

36 Claims, 1 Drawing Sheet

FLEXIBLE CONTAINER FOR COMPRESSED GASES

CROSS REFERENCE

This is a continuation in part of application Ser. No. 07/507,484 filed Apr. 11, 1990 and issued as U.S. Pat. No. 5,036,845 on Aug. 6, 1991 which in turn is a continuation in part of application Ser. No. 07/337,901, filed Apr. 14, 1989 and issued as U.S. Pat. No. 4,932,403 on June 12, 1990.

The above patents are incorporated herein by reference.

BACKGROUND OF THE INVENTION

1. Field of the Invention

This invention relates to containers for compressed gases, and more particularly for containers which may be carried on a person and which may be used for other purposes such as containers for compressed gas for use in vehicles or other applications having weight and space constraints.

2. Related Art

Divers, fire fighters, miners and alike must perform numerous tasks which require that they carry a portable supply of compressed gases. These gases are usually for breathing in unbreathable environments; however, other gases such as carbon dioxide which are used for extinguishing fires are also carried.

Conventional containers for this purpose are normally of a cylindrical shape with domed ends, and construction is usually of steel or aluminum, or glass fiber wound aluminum. Unfortunately, these containers are cumbersome to wear due to their bulky shape, their rigid structure and their relatively heavy weight. As a result, wearers have difficulty moving in confined spaces, are uncomfortable and are subject to increased levels of fatigue.

Prior approaches such as seen in Pat. No. 3,338,238 involves a complex, multicell container which can be made in a relatively flat, oval-shape cross section. However, these containers are difficult to manufacture and do not conform to the shape of the wearer.

Pat. No. 3,491,752 illustrates a slightly flexible pressure vessel made in the form of a coiled spiral tube. This vessel is compact and light weight, but ineffective if more than several minutes of breathing gases are required. While the storage capacity of such a pressure vessel could be increased by using either larger diameter tube or thicker walled tube, the changes are impractical since tubing of increased dimension would not easily coil into a compact shape. Pat. No. 3,432,060, to the same inventor has similar deficiencies.

Pat. No. 1,288,857 illustrates a life preserver with a plurality of closed cylinders constructed of rubber, rubber cloth or other suitable air tight fabric, the cylinders being connected together by smaller tubes which are preferably integral with the cylinders. However, the shape, size, and requirement for connecting pipe sections make the unit expensive to manufacture. Further, because of the need for connecting tubes, etc., it cannot be as compact as desirable for personal use.

Pat. No. 2,380,372 illustrates a flexible, portable container designed to be built into the seat of a parachute that is part of a parachute pack in order to provide oxygen to parachutists. The container includes a length of pipe made in the form of a flat coil, the outer turns of which conform generally to the shape of the seat. The coil of pipe is in the form of a coil in ever decreasing rectangles, squares, or circles which are concentric.

Pat. No. 1,608,267 is another older patent which has a life-ring worn around the waist of a user and has a supply of air therein.

German Patent No. 971,689, issued in 1959, includes a plurality of parallel metal cylinders, connected to succeeding cylinders by means of small metal tubes. This particular device is obviously expensive to make and very heavy to use by a wearer or in industrial applications.

It will be appreciated that the prior types of portable containers had the following disadvantages:

1. If the containers hold more than a few minutes worth of breathing gases, they are large in size and protrude a great distance from the wearer's body.
2. Containers in use at the present time are heavy.
3. The manufacture of existing containers is complex and costly.
4. In the area of compressed natural gas (CNG) containers used, for example in conjunction with automotive vehicles, the containers must be relatively large cylinders or spheres which occupy an inordinate amount of space.

OBJECTS AND SUMMARY OF THE INVENTION

One object of the instant invention is to provide a portable container for compressed gases which will protrude only a small distance from the wearer's body.

Another object is to provide a CNG container which provides a configuration and flexibility to optimize space utilization.

A further object is to provide a container which is relatively light weight.

Still another object of the invention is to provide a container which is economically manufactured to consistently high quality standards.

A further object of the invention is to provide a container which is compact, light weight and easy to manufacture, thus providing storage of a relatively large volume of compressed gases. This will further enable the wearer to work in small spaces in reasonable comfort and without undue fatigue; or in the case of CNG containers, to simply be relatively light in weight and to optimize space utilization.

A container is formed of a length of a plurality of alternating expanded-diameter and narrow-diameter storage and connection sections, respectively. The container includes a liner, a high strength fiber covering the liner and a protective covering over the fiber. A continuous container is thus formed. The container can have a pressure gauge at one end and a pressure valve, a demand flow regulator and a mouthpiece or other connection (for example, to an auto engine) at the other end.

BRIEF DESCRIPTION OF THE DRAWINGS

The above and other objects and advantages of the invention will become apparent from the following description and accompanying drawings wherein.

DETAILED DESCRIPTION OF THE PREFERRED EMBODIMENT

Figure 1:
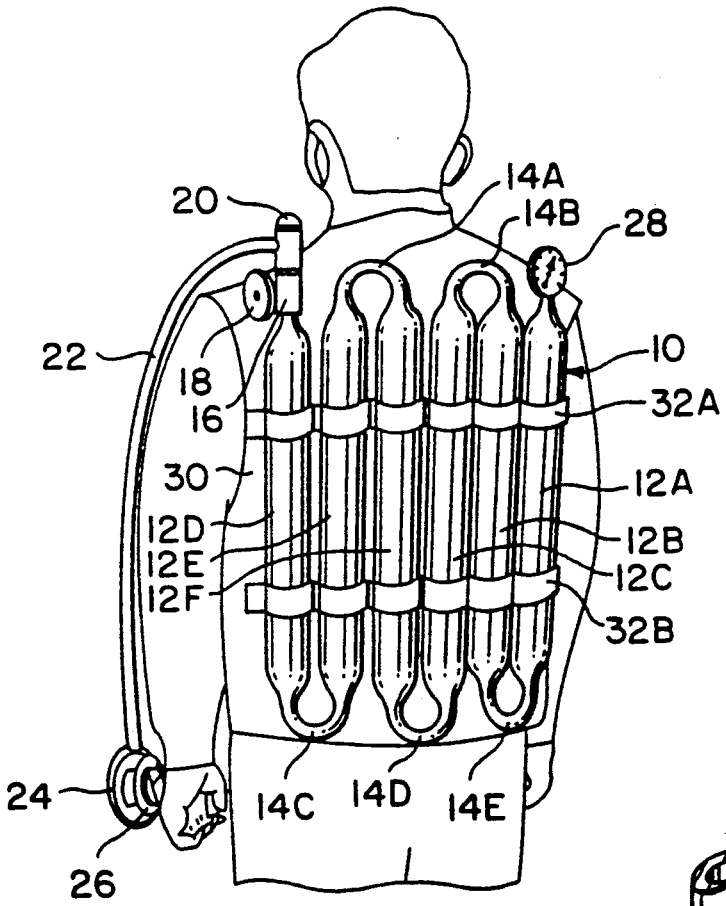
FIG. 1 is a perspective view of a typical embodiment of the container for breathing gases.
Figure 2:
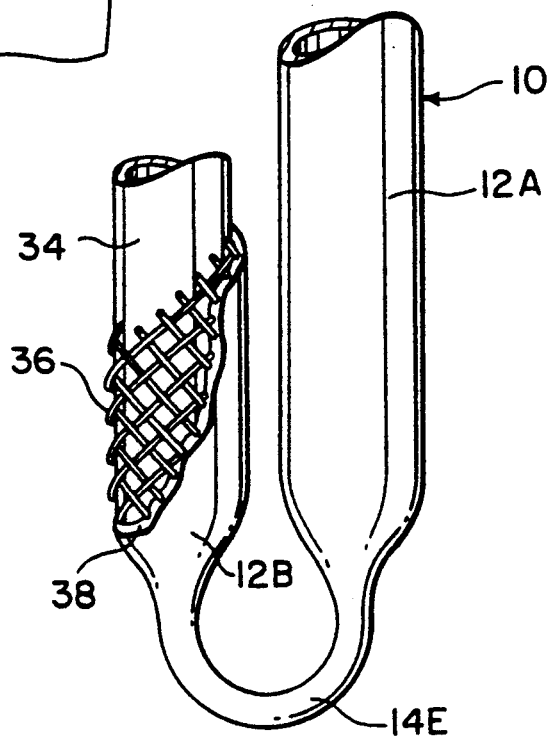
FIG. 2 is an enlarged perspective view, in partial cut-away the typical cross section of the container.

The preferred embodiment of the present invention is illustrated in FIGS. 1 and 2. A container 10 includes a plurality of expanded-diameter, parallel storage sections 12A–F. The expanded-diameter storage sections are connected by alternating narrow-diameter connecting sections 14A–E. The connecting sections permit the arrangement of the expanded-diameter sections in parallel or other arrangement resulting in the connecting sections being maintained in a bent attitude as seen in the drawings.

While one embodiment illustrates the expanded-diameter and narrow-diameter sections of all one continuous length, the container can be manufactured in separate sections and joined in the manufacturing process. Also, while the preferred embodiment illustrates the expanded-diameter sections substantially parallel to each other, other configurations are contemplated wherein the expanded-diameter sections form increasingly narrow "concentric" squares or rectangles, are S-shaped, Z-shaped or otherwise randomly oriented.

It will be appreciated that the expanded diameter storage sections 12A–F serve as the primary storage spaces for the compressed gases.

Attached to one end of the container 10 is a valve 16 operated by a handle 18. A known type of pressure regulator 20 is attached to the valve 16, the pressure regulator reducing the pressure of gases which flow into a low pressure tube 22. The tube 22 provides low pressure gases to a known demand flow regulator 24 which is fitted with an inhalation means such as mouthpiece 26. A face piece or mask could also be used. A known pressure indicator 28 is optionally preferably attached to the other end of the container 10. The end of the container could obviously also be plugged. Further, another regulator, pressure gage or other device for monitoring, controlling or using the compressed gas can be connected to the end. It is further contemplated that the container can be connected to a combustion means such as an auto engine to be driven by the CNG.

The container !0 is fastened to a vest 30 having arm openings and having an upper strap 32A and a lower strap 32B. In place of the vest, it would be possible to mount the container onto a removable pack and harness arrangement such as used by scuba divers, parachutists and like.

Referring to FIG. 2, a typical cross-section in partial cut-away, of the container 10 is illustrated. The liner reduces or eliminates permeation of the compressed gas through the container. The liner can also serve as a mandrel for manufacturing the container. A liner 34 is formed of a noncontaminating material such as nylon. Other materials such as polyethylene, silicon, vinyl, rubber, polypropylene, polyurethane, tetrafluoroethylene, polyester or metal (such as but not limited to aluminum, titanium, steel, stainless steel, nickel alloys, copper, tin, and other alloys thereof) can also be used as the liner. The liner could also be constructed of two or more of the previously listed materials. Additionally, the liner could be formed from the same material that is used to impregnate and coat the reinforcing fibers or strands discussed below. In order to provide the container with high pressure capabilities, the liner 34 is seen covered with a high strength reinforcing fiber such as a high strength braid or winding 36. KEVLAR brand aramid fiber made by E.I. Dupont de Nemours is one type of reinforcing fiber that has been found to work well. Other types of fiber material could be thin metal wire, glass, polyester, carbon fiber, graphite or other fibers or hybrids used in composite structures. One example is ultra-high molecular weight polyethylene sold under the trademark "SPECTRA." The fiber can be braided or wound around the liner using a filament winding process. A hybrid braiding and filament winding process could also be used.

In order to prevent abrasion and wear, and to increase strength (and in certain applications rigidity), the fiber braid or winding 36 is preferably coated with a protective covering material such as polyurethane. As seen in FIG. 2, the coating not only covers the fiber 36, but it impregnates and fills the interstices in the braid or winding. Other types of coating material could be silicon, rubber, vinyl, or combinations thereof. More rigid materials such as epoxy, vinylester or polyester resins could also be used. Depending upon the shape and the configuration of expanded and narrow-diameter sections and the intended use, it would be possible to coat the entire group of storage and connecting sections by molding or dipping the configured sections in one simultaneous operation and the shape of the adjacent sections would not be discernable. The container could also be left uncoated if placed inside a protective pouch or shell.

While specific embodiments of the invention have been described and illustrated, it will be clear that variations in the details of the embodiments specifically illustrated and described may be made without departing from the true spirit and scope of the invention as defined in the appended claims.

What is claimed is:

1. A container for compressed gases, comprising:

a) a container liner, b) a high strength fiber reinforcement covering the liner and forming a continuous container, c) the container being formed to provide a plurality of alternating expanded-diameter storage sections and narrow-diameter sections, the expanded-diameter sections having a cross-section substantially greater than the storage cross-section of the narrow-diameter section and being bent to form a desired configuration, and d) a valve connected to the container.

2. The container of claim 1, including a demand flow regulator connected to the pressure valve.

3. The container of claim 2, including a connector connected to the demand flow regulator.

4. The container of claim 1, wherein the fiber is in the form of a braid.

5. The container of claim 1, wherein the fiber is in the form of a winding.

6. The container of claim 1, wherein the fiber is a combination of a braid and a winding.

7. The container of claim 1, including an inhalation means attached to the valve.

8. The container of claim 1, including means for connecting the container to a combustion means.

9. The container of claim 1, wherein the liner is of a material selected from the group consisting of nylon, polyethylene, silicon, vinyl, rubber, tetrafluoroethylene; polypropylene, polyurethane, polyester and metal.

10. The container of claim 1, wherein the fiber is of a material selected from the group consisting of aramid fiber, metal wire, fiberglass, carbon, ultra high molecular weight polyethylene, and graphite.

11. The container of claim 1, wherein the fiber reinforcement is covered by a material selected from the group consisting of polyurethane, silicon, rubber, vinyl, vinylester, epoxy and polyester resins.

12. The container of claim 1, wherein at least a substantial portion of the alternating sections are of one piece and of a continuous length.

13. The container of claim 1, including a pressure gauge connected thereto.

14. The container of claim 1, wherein the container is mounted on a carrier.

15. The container of claim 14, wherein the carrier is a vest.

16. The container of claim 14, wherein the carrier includes a harness.

17. The container of claim 14, wherein the carrier is worn on a person and extends over the chest and back of the person, and the container includes a substantial portion on both the front and back of the person.

18. The container of claim 4, wherein the protective covering coats the braid and impregnates the interstices of the braid.

19. The container of claim 1, wherein the expanded-diameter sections are substantially parallel to each other.

20. The container of claim 1, wherein the narrow-diameter sections are maintained in a bent attitude.

21. The container of claim 1, wherein the covering simultaneously covers both expanded-diameter and narrow-diameter sections.

22. The container of claim 1, wherein interstices of the fiber are impregnated by the reinforcement covering.

23. A method of containing compressed gases, comprising:

a) forming a plurality of expanded-diameter storage sections and a plurality of narrow-diameter interconnecting sections, b) alternatingly connecting the expanded-diameter sections and the narrow-diameter sections, c) forming a continuous container by covering the sections with a high strength fiber reinforcement.

24. The method of claim 23 including covering the fiber reinforcement with a protective coating.

25. The method of claim 23, wherein the fiber is in the form of a braid.

26. The method of claim 23, wherein the fiber is in the form of a winding.

27. The method of claim 23, wherein the fiber is a combination of a braid and a winding.

28. The method of claim 23, including connecting an inhalation means to the container.

29. The method of claim 23, including forming the liner of a material selected from the group consisting of nylon, polyethylene, silicon, vinyl, rubber, tetrafluoroethylene; polypropylene, polyurethane, polyester and metal.

30. The method of claim 23, including forming the fiber of a material selected from the group consisting of aramid fiber, metal wire, fiberglass, carbon fiber, ultra-high molecular weight polyethylene, and graphite.

31. The method of claim 24, including forming the protective coating of a material selected from the group consisting of polyurethane, silicon, rubber, vinyl, vinylester, epoxy and polyester resins.

32. The method of claim 23, including forming at least a substantial portion of the alternating sections of one piece and of a continuous length.

33. The method of claim 23, including impregnating interstices of the fiber with a protective covering.

34. The method of claim 23, including forming the expanded-diameter sections substantially parallel to each other.

35. The method of claim 23, including maintaining narrow-diameter sections in a bent attitude.

36. The method of claim 23, including simultaneously covering both expanded-diameter and narrow-diameter sections.

* * * * *